United States Patent [19]

Hiro et al.

[11] Patent Number: 4,654,288

[45] Date of Patent: Mar. 31, 1987

[54] ELECTROPHOTOGRAPHIC PHOTOSENSITIVE MEMBER AND PROCESS FOR FORMING ELECTROPHOTOGRAPHIC IMAGES USING SAME

[75] Inventors: Masaaki Hiro, Kanagawa; Tetsuo Hasegawa, Tokyo, both of Japan

[73] Assignee: Canon Kabushiki Kaisha, Tokyo, Japan

[21] Appl. No.: 793,105

[22] Filed: Oct. 30, 1985

[30] Foreign Application Priority Data

Nov. 6, 1984 [JP] Japan ..... 59-233568

[51] Int. Cl.[4] ..... G03G 13/08

[52] U.S. Cl. ..... 430/126; 430/125; 430/67; 430/57

[58] Field of Search ..... 430/67, 57, 126, 125

[56] References Cited

U.S. PATENT DOCUMENTS

| | | | |
|---|---|---|---|
| 3,994,726 | 11/1976 | Wales | 430/131 |
| 4,388,392 | 6/1983 | Kato | 430/57 |
| 4,535,042 | 8/1985 | Kitayama et al. | 430/56 |

*Primary Examiner*—J. David Welsh

*Attorney, Agent, or Firm*—Fitzpatrick, Cella, Harper & Scinto

[57] ABSTRACT

An electrophotographic photosensitive member has a photosensitive layer in which the surface hardness of the photosensitive layer is 10 g. or more which is a vertical load necessary for forming a scratch of 50 μm wide when the vertical load is applied to a diamond or supphire cone pressing member, the conical angle being 90° and the tip being a semispheric shape having a diameter of 0.01 mm and the cone pressing member is moved on the surface of the photosensitive layer at the speed of 50 mm/min.

15 Claims, No Drawings

ELECTROPHOTOGRAPHIC PHOTOSENSITIVE MEMBER AND PROCESS FOR FORMING ELECTROPHOTOGRAPHIC IMAGES USING SAME

BACKGROUND OF THE INVENTION

1. Field of the Invention

This invention relates to an electrophotographic photosensitive member and a process for forming electrophotographic images using said photosensitive member, and more particularly, to an electrophotographic photosensitive member comprising an organic photoconductor and a process for forming electrophotographic images using said photosensitive member.

2. Description of the Prior Art

Heretofore, there have been proposed various organic photoconductive polymers such as polyvinyl carbazole and the like. These polymers are excellent in film shapeability, light weight, high productivity and the like, but are poor in sensitivity, durability, and stability against change of environment as compared with inorganic photoconductive materials.

In place of the high polymer organic photoconductive materials, there have been recently developed many organic photoconductive materials of low molecular weight. Advantages of the organic photoconductive materials of low molecular weight are that the materials can be selected from the wide range of compounds and therefore, it is easy to select the compounds of high sensitivity and good charge retentability. In addition, since there have been proposed laminate photosensitive members of a function separation type comprising a charge generation layer and a charge transport layer, it is possible to produce photosensitive members of high sensitivity.

However, the photosensitive member comprising an organic photoconductive material (OPC photosensitive member) has a drawback, that is, flow of latent images, so-called "image flow", is liable to occur at high temperature and high humidity. This image flow phenomenon is attributable to the very lowered electric resistance resulting from the low electric resistant materials formed on the surface of the photosensitive member by corona discharge and the like and the low electric resistant materials such as paper dust attached to the surface and the like which absorb moisture at high temperature and high pressure.

In order to solve such disadvantages, various methods are developed. For example, materials having corona resistance or humidity resistance have been proposed, but there is not yet any satisfactory material. At present, it is regarded as the best method to mechanically remove such substances of low electric resistance and renew always the surface of the photosensitive member.

However, when an OPC photosensitive member is composed of an organic photoconductive polymer, the surface hardness varies to a great extent depending on the composition and molecular weight. When a low molecular weight organic photoconductive material is used as the OPC photosensitive member, the surface hardness changes depending on the composition and molecular weight of a binder resin and the ratio of the photoconductive material to the binder resin. Therefore, the above-mentioned method of removing mechanically the low electric resistant materials should be effected under a proper condition depending upon the surface hardness of the photosensitive member. That is, in the case where the surface hardness of the photosensitive member is low, strong cleaning injures the surface of the photosensitive member, increases difference in the film thickness when using for a long time, and causes defects of images such as fog and the like.

On the other hand, in case that the surface hardness of the photosensitive member is high while the cleaning power is weak, the low electric resistant material can not be completely removed resulting in image flow.

As the cleaning method, there may be mentioned blade cleaning, magnet brush cleaning, fur brush cleaning, roller cleaning, cleaning using roller and blade in combination, and these are selectively used depending on the surface hardness of the photosensitive member. For example, when the surface hardness is low, a blade cleaning method is mainly used, but as the surface hardness increases, the cleaning becomes poor resulting in image flow since the cleaning power is weak. Consequently, for the purpose of a strong power cleaning, magnet brush cleaning or roller cleaning is employed, but such cleaning has disadvantages such as the necessity of a large apparatus, high cost and the like.

SUMMARY OF THE INVENTION

An object of the present invention is to provide an electrophotographic photosensitive member capable of effectively preventing image flow under high temperature and high humidity.

Another object of the present invention is to provide a process for forming electrophotographic images using the above-mentioned electrophotographic photosensitive member.

A further object of the present invention is to provide a process for forming electrophotographic images capable of preventing image flow.

According to one aspect of the present invention, there is provided an electrophotographic photosensitive member comprising a photosensitive layer overlying an electroconductive substrate in which the surface hardness of the photosensitive layer is 10 g. or more which is a vertical load necessary for forming a scratch of 50 μm wide when the vertical load is applied to a diamond or sapphire cone pressing member, the conical angle being 90° and the tip being a semispheric shape having a diameter of 0.01 mm and the cone pressing member is moved on the surface of the photosensitive layer at the speed of 50 mm/min.

According to another aspect of the present invention, there is provided a process for forming electrophotographic images comprising developing electrostatic latent images formed on the above-mentioned electrophotographic photosensitive member with a developer comprising ceramics fine powders of non-oxide type, transferring the images thus developed and then cleaning the photosensitive member.

DESCRIPTION OF THE PREFERRED EMBODIMENTS

The photosensitive layer of the electrophotographic photosensitive member according to the present invention is preferably composed of an organic photoconductor. As the organic photoconductor, there may be used organic photoconductive polymers such as polyvinyl carbazole and the like, and low molecular weight organic photoconductive materials used together with insulating polymers as the binder. Among the photosensitive members, there are preferably used photosensitive members of a function separation type having a photosensitive layer of a laminate structure constituted of a charge transport layer and a charge generation layer, and more preferably, photosensitive members where a charge generation layer overlies an electroconductive substrate and a charge transport layer overlies the charge generation layer.

In the fabrication of the electrophotographic photosensitive member according to the present invention, a drum or film of metal such as aluminum, stainless steel and the like, paper and plastics may be used as an electroconductive substrate. An undercoating layer (adhesive layer) having a barrier function and an undercoating function may be provided on the substrate.

The undercoating layer is provided so as to improve the adhesivity of the photosensitive layer, improve the coating property, protect the substrate, coat the defective portions at the surface of the substrate, improve the charge injection from the substrate, and protect the electric break of the photosensitive layer.

As a material for the undercoating layer, there may be used polyvinyl alcohol, polyethylene oxide, methyl cellulose, ethylene-acrylic acid copolymer, polyamide, coplymer nylon, gelatine and the like.

These materials are dissolved in respective appropriate solvents and coated on the substrate. The coating film is usually about 0.2–2$\mu$ thick.

In case of the photosensitive member of function separation type, the charge generation material includes selenium, selenium-tellurium, pyrylium, thiopyrylium dyes, phthalocyanine pigments, anthanthrone pigements, dibenzpyrenequinone pigments, pyranthrone pigments, trisazo pigments, bisazo pigments, azo pigment, indigo pigments, quinacridone pigments, asymmetric quinocyanine, quinocyanine, amorphous silicon as disclosed in Japanese Patent Application Laid-open No. 143645/1979 and the like.

The charge transport material includes pyrene, N-ethylcarbazole, N-methyl-N-phenylhydrazino-3-methylidene-9-ethylcarbazole, N, N-diphenylhydrazino-3-methylidene-10-ethylphenothiazine; hydrazones such as p-diethylaminobenzaldehyde-N,N-diphenylhydrazone, p-pyrrolidinobenzaldehyde-N,Ndiphenylhydrazone,p-diethylbenzaldehyde-3-methylbenzthiazolinone-2-hydrazone and the like; 2,5-bis(p-diethylaminophenyl)-1,3,4-oxadiazole; pyrrazolines such as 1-[quinolyl(2)]-3-(p-diethylaminostyryl)-5-(p-diethylaminophenyl)pyrrazoline, 1-[6-methoxypyridyl-(2)]-3-(p-diethylaminostyryl)-5-(p-diethylaminophenyl)pyrrazoline, 1-[lepidyl(2)]-3-(p-diethylamonostyryl)-5-(p-diethylaminophenyl) pyrrazoline, 1-[pyridyl(2)]-3-($\alpha$-methyl-p-diethylaminostyryl)-5-(p-diethylaminophenyl)pyrrazoline, 1-phenyl-3-($\alpha$-benzyl-p-diethylaminostyryl)-5-(p-diethylaminophenyl)pyrrazoline and the like; oxazoles such as 2-(p-diethylaminostyryl)-6-diethylaminobenzoxazole, 2-(p-diethylaminophenyl)4-(p-dimethylaminophenyl)-5-(2-chlorophenyl)oxazole and the like; thiazoles such as 2-(p-diethylaminostyryl)-6-diethylaminobenzothiazole and the like; triarylmethanes such as bis(4-diethylamino-2-methylphenyl)phenylmethane and the like; polyarylalkanes such as 1,1-bis(4-N,N-diethylamino-2-methylphenyl)-heptane, 1,1,2,2-tetrakis(4-N,N-dimethylamino-2methylphenyl)ethane and the like.

The charge generation layer may be formed by dispersing the above-mentioned charge generation material and a binder resin in an amount of 0.5–4 times the amount of the charge generation material in a solvent by means of homogenizer, ultrasonic wave, ball-mill, vibration ball-mill, sand-mill, attritor, roll-mill, or the like, coating and drying. The thickness of the charge generation layer is about 0.1–1$\mu$.

The charge transport layer is usually formed by dissolving the above-mentioned charge transport material and a binder resin in a solvent and coating the surface of the charge generation layer with the resulting solution. The ratio of the charge transport material to the binder resin ranges from about 2:1 to 1:2. The coating operation may be effected by soaking coating, spray coating, spinner coating or the like. Drying may be effected at 10°–200° C., preferably 20°–150° C., for 5 min.–5 hours, preferably 10 min.–2 hours by air-blowing drying or static drying. The thickness of the resulting charge transport layer is about 5–20$\mu$.

A binder resin used for forming the charge transport layer is preferably selected from acrylic resins, styrene resins, polyester resins, polycarbonates, polyarylate, polysulfon, polyphenylene oxide, epoxy resins, polyurethane resins, alkyd resins and unsaturated resins. More preferable binder resins are poly(methyl methacrylate), polystyrene, styreneacrylonitrile copolymers, polycarbonates and diallylphthalate resins. Among them, poly(-methyl methacrylate), polystyrene, styrene-acrylonitrile copolymers and diallyl phthalate resins are particularly preferable.

The charge transport layer may contain various additives such as diphenyl, diphenyl chloride, o-terphenyl, p-terphenyl, dibutyl phthalate, dimethylglycol phthalate, dioctyl phthalate, triphenyl phosphate, methyl naphthalene, benzophenone, chlorinated paraffin, dilauryl thiopropionate, 3,5-dinitrosalicylic acid, various fluorocarbons and the like.

The surface hardness of the photosensitive layer in the electrophotographic photosensitive member according to the present invention is measured as shown below.

The photosensitive member is fixed to, for example, a sample holder of a surface property measuring device of HEIDON 14 Model (tradename, manufactured by Shinto Kagaku Co.).

A vertical load is applied to the surface of the photosensitive layer by means of a diamond or sapphire needle (in a form of a cone, the conical angle being 90°, and the tip being a semispheric shape having a diameter of 0.01 mm), and the sample holder is moved at a speed of 50 mm/min to form a scratch on the surface of the photosensitive member. The width of the scratch is measured, for example, by using a microscope attached to Micro-hardness tester MVK-F (tradename, manufactured by Akashi Seisaku Sho).

The above-mentioned procedure is repeated by changing the vertical load, at intervals of 5 g., for example, 10 g., 15 g., 20 g., 25 g., 30 g., 35 g., 40 g., . . . , and the load necessary for forming a scratch of 50 $\mu$m wide is calculated by using the relation between the scratch width and the load by straight line regression. The load value is used to stand for the hardness. In the case of a photosensitive member of a drum type, the photosensitive member is set to the sample holder such that the scratch is formed in the direction of the drum axis.

The surface hardness of the photosensitive layer of the electrophotographic photosensitive member according to the present invention is 10 g. or more in terms of the vertical load, preferably 12–50 g.

The ceramic fine powder of non-oxide type used as a component in the developer of the process for forming electrophotographic images according to the present invention includes, for example, fine powders of SiC, AlN, $MoSi_2$, $LaB_6$, $B_4C$, TiC, WC, TiN, $Si_3N_4$, $MoS_2$, BN, CrC, AlON and the like. SiC fine powder is particularly preferable.

Ceramic fine powder of oxide type or non-oxide type has preferably a particle size of 0.1$\mu$ or less, and the oil absorbing amount is preferably 5–50 ml per 100 g. of the fine powder.

The fine powders may be produced by mechanical pulverization, atomization, sintering, evaporation in gas, plasma evaporation, hydrogen arc heating, oil surface vapor deposition, high frequency induction heating, arc evaporation, heat decomposition, CVD, gas reduction, electrolysis, active hydrogen-melting method or the like.

In order to enhance effectively the abrasion action of the developer containing ceramic fine powders of non-oxide type, it is preferable to incorporate ceramic fine powders of oxide type in the developer.

The ceramic fine powders of oxide type used in the developer for the electrophotographic image forming process of the present invention are, for example, particles or powders of alumina, titanium dioxide, barium titanate, magnesium titanate, calcium titanate, strontium titanate, zinc oxide, silica sand, clay, mica, wallastonite, diatomaceous earth, various inorganic metal oxide pigments, chromium oxide, cerium oxide, red iron oxide, antimony trioxide, zinc oxidebismuth oxide, bismuth oxide, magnesium oxide, zirconium oxide, beryllium oxide, $Pb(Zr_xTi_{1-x})O_3$, $Zn_{(1-x)}Mn_x$ $Fe_2O_4$ where $O<X<1$, and the like. Silica fine powders are particularly preferable.

Silica fine powders as mentioned here are fine powders having an Si-O-Si bond which may be produced by a dry method or a wet method.

The amount of the ceramic fine powder of oxide type and that of the ceramic fine powder of non-oxide type are effectively 0.01–10 parts by weight and 0.1–10 parts by weight per 100 parts by weight of a magnetic toner, respectively, particularly preferably, these two kinds of ceramic fine powders are used in combination in amounts of 0.1–2 parts by weight and 0.1–5 parts by weight, respectively.

On the other hand, in case that electrostatic latent images on the electrophotographic photosensitive member are developed with a one-component magnetic toner which is positively triboelectrically charged, the image flow can be effectively prevented by incorporating only ceramic fine powders of non-oxide type, preferably SiC fine powders, in the developer. The amount of the ceramic fine powders of non-oxide type to be added is 0.1–3% by weight, preferably 0.5–2% by weight based on the amount of the magnetic toner powders. However, in case that a developer composed of a magnetic powder toner and the above-mentioned SiC fine powders only is used, filming is liable to form on the surface of the photosensitive member when the surface is cleaned by a known cleaning method, in particular, blade cleaning. Therefore, it is preferable to add an appropriate lubricant to the developer. As the lubricant, various colorless or white fine powders may be used. In particular, as a lubricant which does not adversely affect the cleaning effect when used together with a positively triboelectrically charged toner, there are preferably used polyvinylidene fluoride and various fatty acid metal salts (more preferably, zinc stearate).

As mentioned above, according to the present invention, the electrophotographic photosensitive member whose photosensitive layer has a limited range of the surface hardness can solve all the problems, that is, image flow, filming, and flaws, and furthermore, even under high temperature and high humidity, there can be always produced clear images free from image flow. In addition, according to the process for forming electrophotographic images using the electrophotographic photosensitive member of the present invention, the excellent features of the electrophotographic photosensitive member as mentioned above are exhibited even when the photosensitive member is cleaned by a blade cleaning method.

The present invention will be described more in detail referring to the following examples.

EXAMPLE 1

An aluminum cylinder (80$\phi$×300 mm) was used as a substrate. A 5% solution of polyamide resin (AMYLAN CM 8000, tradename, manufactured by Torey Co. Ltd.) in methanol was applied to the aluminum cylinder by an immersing method to form an undercoating layer of 1$\mu$ thick.

Then, 10 parts (by weight; in the following, parts are also by weight) of a bisazo pigment of the following formula,

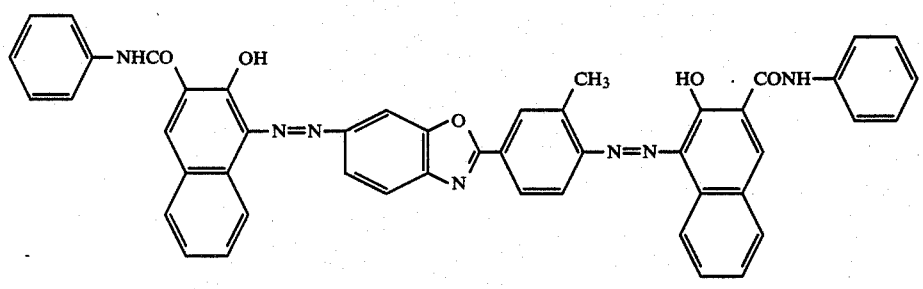

8 parts of polyvinyl butyral resin (S-LEC BXL, tradename, manufactured by Sekisui Kagaku K.K.) and 60 parts of cyclohexanone were dispersed in a sandmill apparatus using 1$\phi$ glass beads for 20 hours. To the resulting dispersion was added 70–120 (accordingly) parts of methyl ethyl ketone, and the resulting mixture was applied in the thickness of 0.12 micron to the surface of the under-coating layer.

Then, 7 parts of a hydrazone compound of the formula,

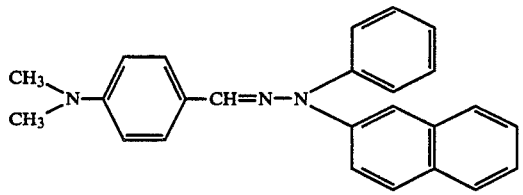

and 10 parts of a polystyrene resin (DIALEX HF-55, tradename, manufactured by Mitsubishi Monsanto Kasei K.K.) were dissolved in 50 parts of monochlorobenzene. The resulting solution was applied to the surface of the above-mentioned charge generation layer. The thickness of the resulting film after drying was 17μ. The surface hardness of the photosensitive member thus produced was measured by the above-mentioned method. It was 13 g.

This photosensitive member was subjected to a running test at high temperature and humidity such as 35° C. and 80% of relative humidity by using an electrophotographic copying machine constituted of a corona charging device of −5.6 KV, an exposing optical system giving an exposure amount of 13 lux.sec, a developer, a transfer charger, a discharging exposing optical system and a blade cleaner.

The cleaner conditions were: silicone rubber blade having rubber hardness of 65°; blade pressure of 20 g/cm; contact angle of 28°; and deformation amount of the blade tip in the direction perpendicular to the photosensitive member surface of 1.5 mm.

When a one-component magnetic toner not containing an abrasive was used for a running test of copying 3000 sheets, image flow did not occur, but a number of flaws were observed on the surface of the photosensitive member and also filming was observed.

On the contrary, when a toner containing 0.5% SiC fine powders and 0.5% zinc stearate was used, neither image flow nor filming was observed even after a running test of copying 3000 sheets.

EXAMPLE 2

Repeating the procedure of Example 1 except that a styrene-acrylonitrile copolymer (Sanlex SAN-C, tradename, manufactured by Mitsubishi Monsanto Kasei K.K.) was used in place of polystyrene resin, there was produced a photosensitive member. The surface hardness of the photosensitive member was 17 g.

A one-component magnetic toner containing 0.5% SiC fine powders and 0.5% zinc stearate was used for a running test of copying 3000 sheets in a manner similar to Example 1. No image flow occurred at all and good images were produced.

EXAMPLE 3

Repeating the procedure of Example 1 except that a styrene-methyl methacrylate copolymer (ESTYLENE MS-300, tradename, manufactured by Shinnittetsu Kagaku K.K.) was used in place of polystyrene resin, a photosensitive member was produced. The surface hardness of the photosensitive member was 21 g.

Then a one-component magnetic toner to which an abrasive was not added, and a one component magnetic toner containing 0.2% silica fine powders and 0.2% SiC fine powders were used respectively for running test of copying 3000 sheets in a manner similar to Example 1.

As the result, when the toner containing no abrasive was used, image flow occurred while when the toner containing the abrasives were used, no image flow occurred at all and good images were obtained.

EXAMPLE 4

Repeating the procedure of Example 1 except that polymethyl methacrylate (DIANAL BR-88, tradename, manufactured by Mitsubishi Rayon K.K.) was used in place of polystyrene resin, a photosensitive member was produced. The surface hardness was 36 g.

A one-component magnetic toner containing no abrasive, a one-component magnetic toner containing 0.2% silica fine powders and 0.2% SiC fine powders, and a one-component magnetic toner containing 1% silica fine powders and 2% SiC fine powders were used respectively for running test of copying 10,000 sheets under the conditions similar to Example 1.

When the toner containing no abrasive was used, image flow occurred at about the 100th copied sheet. When the toner containing 0.2% silica fine powders and 0.2% SiC fine powders was used, image flow did not occur up to the 3000 copied sheet. Further when the toner containing 1% silica fine powders and 2% SiC fine powders was used, image flow did not occur up to the 10,000 copied sheet and gave good images.

EXAMPLE 5

A photosensitive member produced by the procedure of Example 4 was coated with a resin liquid composed of 10 parts of diallylphthalate resin and 0.1 part of benzoyl peroxide dissolved in 40 parts of monochlorobenzene followed by heating at 120° C. for 60 min. to form a resin protective layer of 1.5μ thick. The surface hardness of the resulting photosensitive member was 46 g. A one-component magnetic toner containing 2% silica fine powders and 4% SiC fine powders was used for running test under the conditions similar to those in Example 1. As the result, image flow did not occur up to 30,000 copied sheet at all through some fog was formed due to $V_L$ up resulting from providing the protective layer.

What is claimed is:

1. A process for forming electrophotographic images which comprises developing, with a developer comprising ceramic fine powders of non-oxide type, electrostatic latent images formed on an electrophotographic photosensitive member comprising a photosensitive layer overlying an electroconductive substrate where the surface hardness of the photosensitive layer is 10 g. or more which is a vertical load necessary for forming a scratch of 50 μm wide when the vertical load is applied to a diamond or sapphire cone pressing member, the conical angle being 90° and the tip being a semispheric shape having a diameter of 0.01 mm and the cone pressing member is moved on the surface of the photosensitive layer at the speed of 50 mm/min, transferring the images thus developed and then cleaning the photosensitive member.

2. A process for forming electrophotographic images according to claim 1 in which SiC fine powders are used as the cderamic fine powders of non-oxide type.

3. A process for forming electrophotographic images according to claim 1 in which the developer contains additionally ceramic fine powders of oxide type.

4. A process for forming electrophtographic images according to claim 3 in which the ceramic fine powders of oxide type are silica fine powders.

5. A process for forming electrophotographic images which comprises developing, with a developer comprising a magnetic toner, ceramic fine powders of oxide type and ceramic fine powders of non-oxide type, electrostatic latent images formed on an electrophotographic photosensitive member comprising a photosensitive layer overlying an electroconductive substrate where the surface hardness of the photosensitive layer is 10 g. or more which is a vertical load necessary for forming a scratch of 50 μm wide when the vertical load is applied to a diamond or sapphire cone pressing member, the conical angle being 90° and the tip being a semispheric shape having a diameter of 0.01 mm and the cone pressing member is moved on the surface of the photosensitive layer at the speed of 50 mm/min, transferring the images thus developed and then cleaning the photosensitive member.

6. A process for forming electrophotographic images according to claim 5 in which the ceramic fine powders of oxide type are silica fine powders and the ceramic fine powders of non-oxide type are SiC fine powders.

7. A process for forming electrophotographic images which comprises developing, with a developer comprising a magnetic toner, ceramic fine powders of non-oxide type and a lubricant, electrostatic latent images formed on an electrophotographic photosensitive member comprising a photosensitive layer overlying an electroconductive substrate where the surface hardness of the photosensitive layer is 10 g. or more which is a vertical load necessary for forming a scratch of 50 μm wide when the vertical load is applied to a diamond or sapphire cone pressing member, the conical angle being 90° and the tip being a semispheric shape having a diameter of 0.01 mm and the cone pressing member is moved on the surface of the photosensitive layer at the speed of 50 mm/min, transferring the images thus developed and then cleaning the photosensitive member.

8. A process for forming electrophotographic images according to claim 7 in which the ceramic fine powders of non-oxide type are SiC fine powders.

9. A process for forming electrophotographic images according to claims 1, 5 or 7 including employing a photosensitive layer having a laminate structure comprising a charge generation and a charge transport layer.

10. A process for forming the electrophotographic images according to claims 1, 5 or 7 including employing a photosensitive member comprising, in sequence, an electroconductive substrate, a charge generation layer and a charge transport layer.

11. A process for forming electrophotographic images according to claim 10 including utilizing a charge transport layer formed of a binder resin selected from the group consisting of acrylic resins, styrene resins, polyester resins, polycarbonates, polyarylate, polysulfone, polyphenylene oxide, epoxy resins, polyurethane resins, alkyd resins and unsaturated resins.

12. A process for forming electrophotographic images according to claim 11 including selecting the binder resin from the group consisting of poly(methyl methacrylate), polystyrene, styrene-acrylonitrile copolymers, polycarbonates and diallylphthalate resins.

13. A process for forming electrophotographic images according to claim 9 including employing a photosensitive layer formed from (1) an organic photoconductive polymer or (ii) low molecular weight organic photoconductive materials dispersed in an insulating polymer.

14. A process for forming electrophotographic images according to claim 9 including employing a charge transport layer comprising a charge transport material and a binder resin in a weight ratio of from about 2:1 to 1:2.

15. A process for forming electrophotographic images according to claim 9 including employing a charge generation layer comprising a charge generation material and a binder resin in a weight ratio of 0.5 to 4 parts binder resin per part charge generation material.

* * * * *